US008684039B2

(12) United States Patent
Cai

(10) Patent No.: US 8,684,039 B2
(45) Date of Patent: Apr. 1, 2014

(54) SHOWER ASSEMBLY WITH SUPPORTING ARM

(75) Inventor: Jiamao Cai, Xiamen (CN)

(73) Assignee: Xiamen Lelin Sanitary Ware Co., Ltd., Xiamen (CN)

( * ) Notice: Subject to any disclaimer, the term of this patent is extended or adjusted under 35 U.S.C. 154(b) by 459 days.

(21) Appl. No.: 13/213,681

(22) Filed: Aug. 19, 2011

(65) Prior Publication Data

US 2013/0042937 A1 Feb. 21, 2013

(51) Int. Cl.
*E03C 1/06* (2006.01)

(52) U.S. Cl.
USPC ..... 137/801; 4/601; 4/615

(58) Field of Classification Search
USPC ..... 137/801; 4/601, 615
See application file for complete search history.

(56) References Cited

U.S. PATENT DOCUMENTS

| | | | | | |
|---|---|---|---|---|---|
| 2,697,839 | A * | 12/1954 | Jackson | 4/615 |
| 5,070,553 | A * | 12/1991 | Chambers | 4/615 |
| 5,148,556 | A * | 9/1992 | Bottoms et al. | 4/567 |
| 5,813,431 | A * | 9/1998 | Cool et al. | 137/360 |
| 6,757,920 | B2 * | 7/2004 | Antoniello et al. | 4/570 |
| 7,458,112 | B1 * | 12/2008 | Yang | 4/601 |
| 8,191,185 | B2 * | 6/2012 | Tsai | 4/601 |

* cited by examiner

*Primary Examiner* — John Fox
(74) *Attorney, Agent, or Firm* — Rabin & Berdo, P.C.

(57) ABSTRACT

A shower assembly with supporting arm has: a water inlet connected to the supporting arm and to a descending pipe; a switching valve body fixed and connected to the end of the pipe through an outer water inlet and having an outer and a inner water outlet connected to a ascending inner tube in the pipe; and an upper branch pipe fixed to the location of the water inlet and connected to the inner tube, of which the end has one or at least one upper water outlet, wherein the switching valve body has a valve core inside, which makes the pipe connected to the outer and the inner water outlet respectively or simultaneously. The switching valve body that is at the end of the pipe controls the current export from the upper and the outer water outlet beneath the switching valve body.

15 Claims, 7 Drawing Sheets

SHOWER ASSEMBLY WITH SUPPORTING ARM

FIELD OF THE INVENTION

The present invention relates to a shower equipment in bathroom, more particularly to a shower assembly connected to the supporting arm from wall.

BACKGROUND OF THE INVENTION

The supporting arm for showering is a standard setting of bathroom in some countries, which transversely extends from the vertical wall that has pre-casting pipe, so that the users can mount any kinds of shower assembly according to their needs. Its original idea is to mount a top-down water injection assembly, such as a head shower succinctly mounted to achieve shower function.

In fact, we found that only mounting one head shower is difficult to fulfill multiple demands. For example, the height of the water outlet of the shower supporting arm is not enough so that it cannot fulfill the demands of the tall users; and the function is simple because of the fixing position of the head shower.

Some improvements have been made to solve the problem mentioned above. The common way is to lead out a pipe from the supporting arm and then to connect a head shower in the high position and a handheld shower in the low position of the pipe so that the height of head shower is enough and the shower functions in the low position is diversified. There are some defects in this kind of scheme: firstly, the water pressure is on the low side so that the injection force of the water column generated from the head shower connected to the supporting arm is not enough, wherein the reason is that the cross-sectional area of the head shower's current passage is pressure-relief structure changing from being minor to being major: when the pressure of the current passage is low, the pressure of the injection force of the water column generated from the head shower is accordingly low; using the handheld shower and the head shower simultaneously produces bad spraying effect, because the pressure of the current passage is lower, which makes the injection force generated both from the head and hand shower accordingly lower; secondly, the assembly structure is complicated so that the mounting and using is not convenient; thirdly, the position of the switching valve body is at the end of the supporting arm, and it is too high to handle.

SUMMARY OF THE INVENTION

The object of the present invention is to offer a shower assembly with supporting arm that can solve said problems at the prior art:

A shower assembly with supporting arm comprising:

a water inlet connected to the supporting arm and to a descending pipe;

a switching valve body fixed and connected to the end of said pipe through an outer water inlet and having an outer water outlet and a inner water outlet connected to a ascending inner tube in said pipe;

and an upper branch pipe fixed to the location of said water inlet and connected to said inner tube, of which the end has one or at least one upper water outlet;

wherein said switching valve body has a valve core inside, which makes said pipe connected to said outer water outlet and said inner water outlet respectively or simultaneously; from said water inlet, an intact current passage is formed through said pipe, outer water inlet, switching valve body, inner water outlet, inner tube and upper water outlet in turn.

As the preferred embodiments according to the present technical scheme, some corresponding improvements can be made in the following aspects:

Based on a preferred embodiment according to said technical scheme, the cross-sectional area of said inner tube is less than the result of the cross-sectional area of said pipe minus the cross-sectional area of said inner tube.

Based on a preferred embodiment according to said technical scheme, said water inlet has the universal ball structure.

Based on a preferred embodiment according to said technical scheme, said switching valve body has a fixed disk apparatus that can be fixed to the wall surface, and the connecting structure between the fixed disk and the wall surface could be adhesion, magnet, negative pressure or the combination of the three methods mentioned above.

Based on a preferred embodiment according to said technical scheme, said fixed disk apparatus includes a universal ball structure.

Based on a preferred embodiment according to said technical scheme, the outer diameter of said upper branch pipe is identical to the outer diameter of said pipe at the position of said water inlet, and they all have smooth and continuous outside surface.

Based on a preferred embodiment according to said technical scheme, said upper branch pipe extends from said water outlet to height and there is at least one downward elbow at the end of said upper branch pipe, wherein a head shower is fixed at the end of the elbow.

Based on a preferred embodiment according to said technical scheme, a tube is connected to the outer water outlet of said switching valve body, and a handheld shower is fixed and connected to another end of said tube.

Based on a preferred embodiment according to said technical scheme, a slide bushing is mounted on said pipe, which has a shower seat used to splice said handheld shower.

Based on a preferred embodiment according to said technical scheme, said valve core comprises:

a switching cavity connected to said outer water inlet, said inner water outlet and said outer water outlet;

a valve core axis reelingly interacted with the interior of said switching cavity, wherein a filler block reelingly blocking the current of said outer water inlet and/or said inner water outlet around said valve core axis is present;

a knob fixed to said valve core axis.

Based on a preferred embodiment according to said technical scheme, said slide bushing has a bascule that can enclasp or relax said pipe.

The benefits generated by the present invention are:

1. The switching valve body that is at the end of the pipe controls the current export from the upper water outlet and the outer water outlet beneath the switching valve body, so that it is easy to handle and the height is suitable.

2. The descending current is in the pipe, and the ascending current is in the inner tube. The inner tube with appropriate inner diameter can ensure enough pressure and flow rate from the water outlet of the upper branch pipe, and it works together with the inferior outer water outlet to achieve good and stable outlet spraying effect from the upper end and lower end at the same time. When the annular cross-sectional area between the pipe and the inner tube is smaller than the current cross-sectional area of the inlet tube, the current pressure between the pipe and the aqueduct is increased according to the fluid mechanics principle; further, the current cross-sectional area of the inner tube is smaller than the annular cross-sectional area between the pipe and the inner tube, so that the current pressure in the inner tube is increased and then the injection force of the water column is stronger, so the deficiency of the injection force from the head shower because of the low water pressure is overcome.

3. The universal ball structure at the water inlet is convenient to mount on the supporting arm integrally and to adjust the posture.

4. There is a universal ball at the fixed disk of the water inlet, coupling with the universal ball at the water inlet, so that the pipe and the two fixed points have considerable flexibility; in one aspect, the pipe interacted with the two balls can locate properly, no matter how different is the length of the supporting arm extended from wall or how rough is the mounting surface; in another aspect, when some inclination of the integrally mounting exist, it can keep the pipe vertical by adjusting the universal ball at the switching valve body.

5. The exterior of the upper branch pipe and the pipe have the same smooth surface in the position of the water inlet, and it make the overall profile gliding, slinky with even mechanical strength.

6. The upper water outlet can raise the export point of the current to the altitude above the supporting arm; in another aspect, the users do not need to stand against the wall and are apart from the water inlet, so that a larger activity space can be formed.

REFERENCE SIGNS

100 pipe; 101 water inlet; 102 ball; 130 inner tube

200 switching valve body; 201 inner water outlet; 202 outer water outlet; 203 outer water inlet; 204 fixed disk; 205 valve core axis; 206 filler block; 207 knob; 208 long screw; 209 valve core; 210 switching cavity; 212 permanent seat; 213 ball joint-lower; 214 ball seat; 215 shell; 216 pin;

300 upper branch pipe; 301 joint of the upper branch pipe; 302 upper water outlet;

400 supporting arm;

500 slide bushing; 501 shower seat; 502 elastic button; 503 compression spring; 504 fastening end; 505 jacket; 506 lining frame; 507 revolving shaft;

601 head shower; 602 handheld shower; 603 tube.

DESCRIPTION OF THE PREFERRED EMBODIMENTS

With the following description of the drawings and specific embodiments, the invention shall be further described in details.

Figure 1:
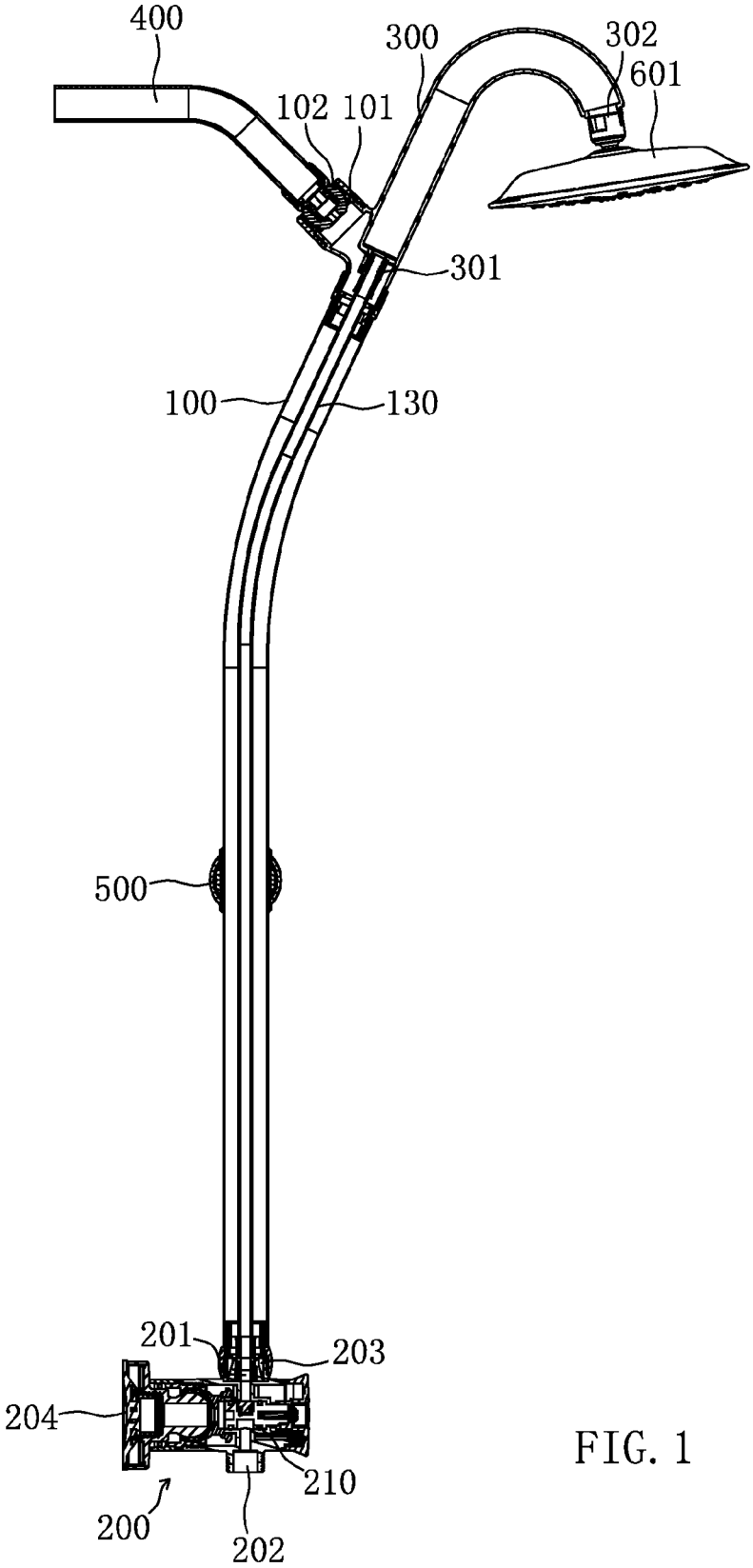
FIG. 1 shows the side view with sectional view according to the embodiment.
Figure 2:
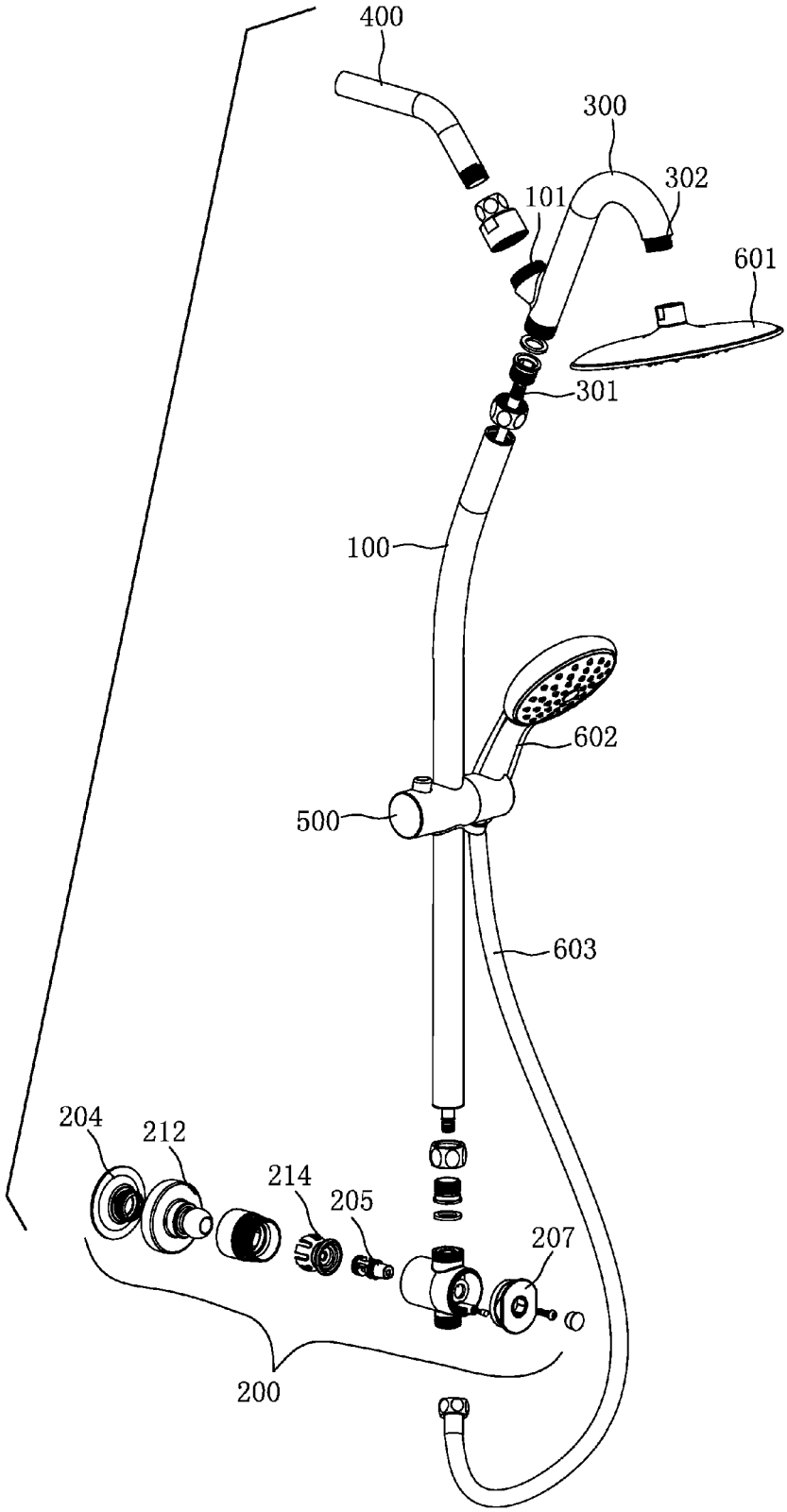
FIG. 2 shows the exploded view according to the embodiment of FIG. 1.

FIG. 1 shows the side view with sectional view according to the embodiment; the water inlet 101 is connected to the supporting arm 400 and to a descending pipe 100;

With the reference of FIG. 2, a switching valve body 200 is fixed to the descending end of the pipe 100; the switching valve body 200 is fixed and connected to the end of the pipe 100 through an outer water inlet 203, and has an outer water outlet 202 and a inner water outlet 201 connected to a ascending inner tube 130 in the pipe 100;

An upper branch pipe 300 is fixed to the location of the water inlet 101, and it is connected to the inner tube 130 in this location through a joint 301 of the upper branch pipe, and the upper branch pipe 300 extends to another end away from the water inlet 101; the another end has one or at least one upper water outlet 302. According to the scheme mentioned above, in one aspect, the upper water outlet can raise the export point of the current to the altitude above the supporting arm 400; in another aspect, the users do not need to stand against the wall and are apart from the water inlet 101, so that a larger activity space is formed; in fact, the upper branch pipe 300 can be a form that there are several showers in parallel to fulfill the demand of the high post shower scheme which has multiple directions and different angles.

The cross-sectional area of the inner tube 130 is less than the result of the cross-sectional area of the pipe 100 minus the cross-sectional area of the inner tube 130. It makes the current pressure in the inner tube 130 enough, so that the deficiency of the injection force of the water column is overcome. This is one of the benefit from the inner tube way.

The switching valve body 200 has a valve core 209 of which the function is to switch the export of the current to the inner water outlet 201 and/or the outer water outlet 202 after the current coming from the pipe 100 flows through the outer water inlet 203.

The water inlet 101 has the universal ball structure, of which the end being against the connecting part of the pipe 100 can be bent freely within limits via the ball 102, so that the whole assembly has considerable flexibility and convenience when it is fixed to the wall surface.

The fixed form of the connections between the water inlet 101 and the supporting arm 400, the pipe 100 and the switching valve body 200 is thread bushing which is coaxial to the pipe, so that it makes the connection tight and doesn't do harm to the simplicity of the structure and the low material cost.

There is a fixed disk 201 at the wall side of the switching valve body 200. This kind of fixed form makes the switching valve body 200 itself become a fixed point, and is convenient to disassemble from and change place on the wall surface. This fixed disk apparatus also includes a universal ball structure to couple with the ball of the water inlet 101, so that the whole pipe 100 has good flexibility of mounting angles; because of the difference of the supporting arms's length extended from the wall surface, the inclination angles of the pipes 100 mounting on the supporting arms with different length are different, and the present of the ball makes the inclination angles adjustable; in addition, the mounting surface against the fixed disk 204 is not always vertical to the root of the supporting arm 400, and it may be oblique, so the fixed disk 204 may be oblique along with the mounting surface, and the ball joint-lower 213 can be adaptive to this kind of situation.

The outer diameter of the upper branch pipe 300 is identical to the outer diameter of the pipe 100 at the position of the water inlet 101, and they all have smooth and continuous outside surface. This kind of the structure makes the outer diameters of the upper branch pipe 300 and the pipe 100 identical through the whole body, so that the uniformity of the integral mechanical strength is ensured.

The upper branch pipe 300 extends upwards from said water outlet 101 to height and there is at least one downward elbow at the end of said upper branch pipe 300, wherein a head shower 601 is fixed at the end of the elbow through the upper water outlet 302.

Figure 3:
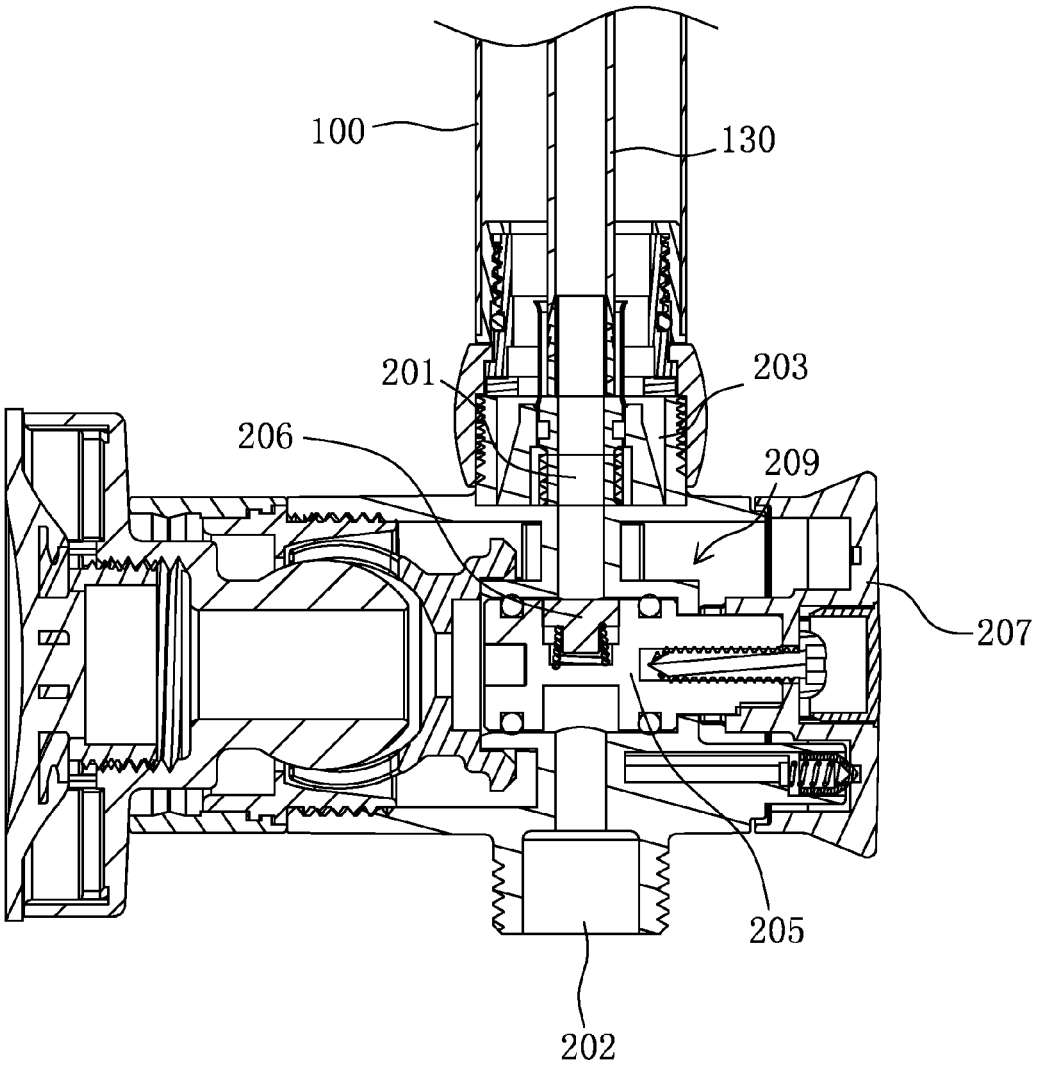
FIG. 3 shows partial details of the valve core 209 according to the embodiment of FIG. 1.

FIG. 3 shows partial details of the valve core 209 according to the embodiment of FIG. 1; with the reference of FIG. 1, the valve core 209 has a switching cavity 210 connecting said outer water inlet, said inner water outlet and said outer water outlet; a valve core axis 205 is reelingly interacted with the interior of said switching cavity 210, and a filler block 206 is present on the lateral face of the valve core axis 205, wherein the filler block 206 reelingly blocks the current from the outer water inlet and/or the inner water outlet around the valve core axis 205, so that the water from the outer water inlet is exported from the upper branch pipe, or from the basal outer water outlet, or from the upper branch pipe and the outer water outlet simultaneously. The knob 207 is fixed to the valve core axis 205, by which the rotation of the valve core axis 205 is controlled.

Figure 4:
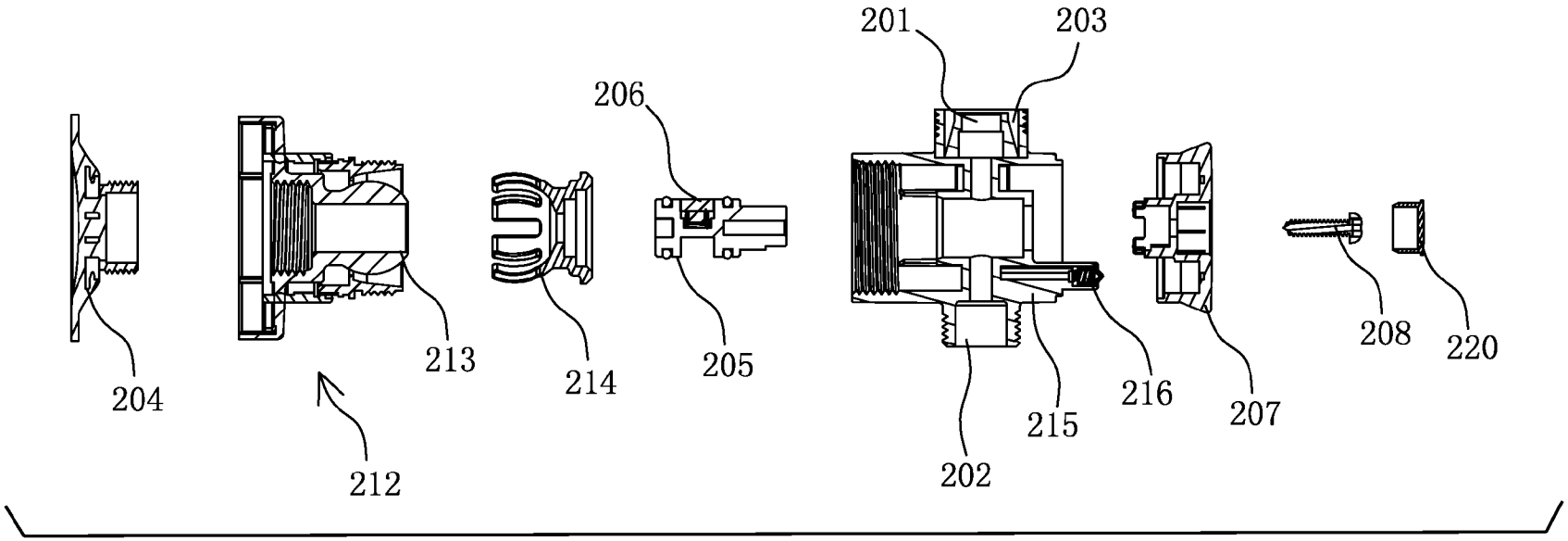
FIG. 4 shows the side and exploded view of the switching valve body 200 according to the embodiment of FIG. 1.

FIG. 4 shows the side and exploded view of the switching valve body 200 according to the embodiment of FIG. 1, and it exhibits all the components and their relationship. The fixed disk 204 is fixed on the permanent seat 212 which has a ball joint-lower 213 to interact with the ball seat 214; the ball seat 214 is click-shaped and flexible so that the ball joint-lower 213 can be stuffed into the ball seat 214 directly; the ball seat 214 is fixed to the shell 215.

Another part comprises the valve core axis 205 and the filler block 206 with spring and located on the valve core axis 205; the outside knob 207 is fixed to the valve core axis 205 through the long screw 208, so that the current from the outer water inlet 203 can be chosen to export from the inner water outlet 201, or from the outer water outlet 202, or from both of them simultaneously through the location selection of the filler block 206 by the knob 207.

A pin 216 with spring is axially mounted at the end of the shell 215 pointing to the knob 207. The pin 216 interacts with the concave pit in the knob 207 to achieve the revolving location of the knob 207. In one aspect, it makes the current selection more stable; in another aspect, it has hand feel as if tap position exists when the knob rotates. Considered the apparent element, a sunk hat 220 that is at the outside end of the knob 207 covers the long screw 208 and its hole site.

The ball joint-lower 213 that is beneath the switching valve body 200 makes the balls of the fixed disk 204 and the water inlet 101 couple with each other, and then a active form with two points is constituted, so that the whole apparatus is not affected by the angle or the length of the supporting arm 400 or the planeness of the wall surface beneath the supporting arm 400, and it can be fixed effectively and quickly. According to the actual situation, the fixed disk 204 can also be changed to viscose gluing the smooth and even-bedded mounting surface; or to magnet structure interacting with the component on the wall surface.

Figure 5:
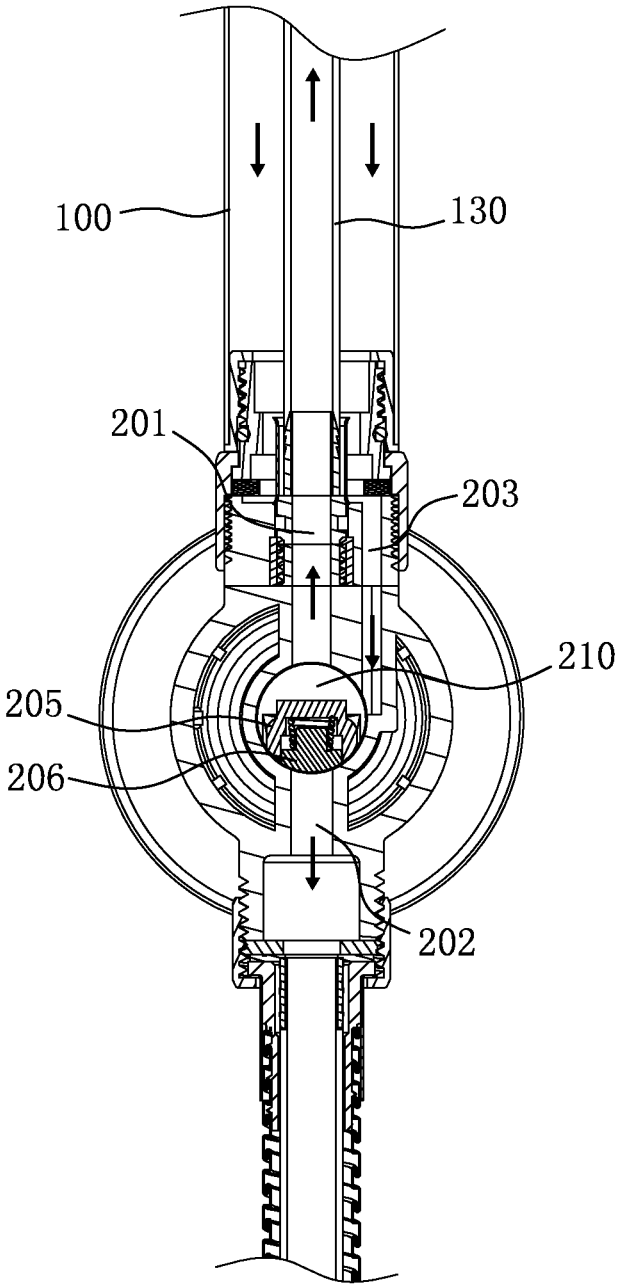
FIG. 5 shows the cross section view of the switching valve body 200 with current according to the embodiment of FIG. 1.

FIG. 5 shows the cross section view of the switching valve body 200 with current according to the embodiment of FIG. 1, and it exhibited the details of current in the switching valve body 200. The switching cavity 210 connects the outer water inlet 203, inner water outlet 201 and outer water outlet 202 simultaneously; along with the changing of the valve core axis 205' rotation angles in the switching cavity 210, different functions can be achieved by blocking the corresponding current channel through the filler block 206 on the valve core axis: the descending current in the pipe 100 enters the outer water inlet 203 from the exterior of the inner tube 130, if the filler block 206 blocks the inner water outlet 201, the current exports from the outer water outlet 202 alone; if the filler block 206 blocks the outer water outlet 202, the current exports from the inner water outlet 201 alone; if the filler block blocks none of the current channel, the current exports from the inner water outlet 201 and the outer water outlet 202 simultaneously; all the operation mentioned above can be achieved just by rotating the valve core axis 205 to different angles.

Figure 6:
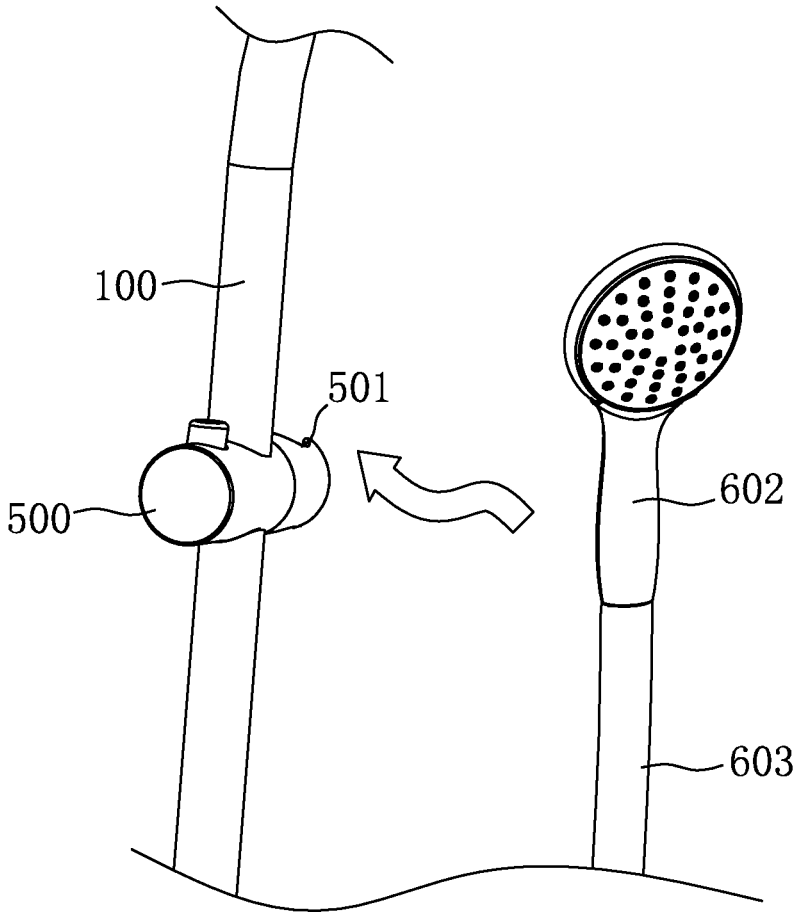
FIG. 6 shows the abridged general view of the slide bushing 500 used to fix the handheld shower 602.

FIG. 6 shows the abridged general view of the slide bushing 500 used to fix the handheld shower 602; a tube 603 is connected to the outer water outlet 202 of the switching valve body 200, wherein a handheld shower 602 is connected and fixed to the other end of the tube 603. A slide bushing 500 is fixed to the pipe 100, wherein the slide bushing 500 has a bascule that can enclasp or relax said pipe, splicing the shower seat 501 of the handheld shower 602; the altitude of the slide bushing 500 can be adjusted along the pipe 100, so that it is easy to load and unload the handheld shower 602 from the shower seat 501.

Figure 7:
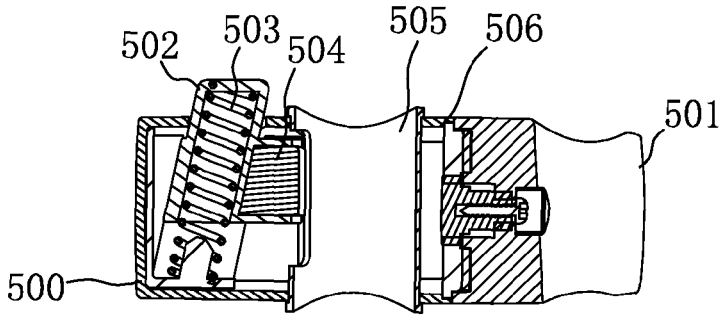
FIG. 7 shows the sectional view of the slide bushing 500.
Figure 8:
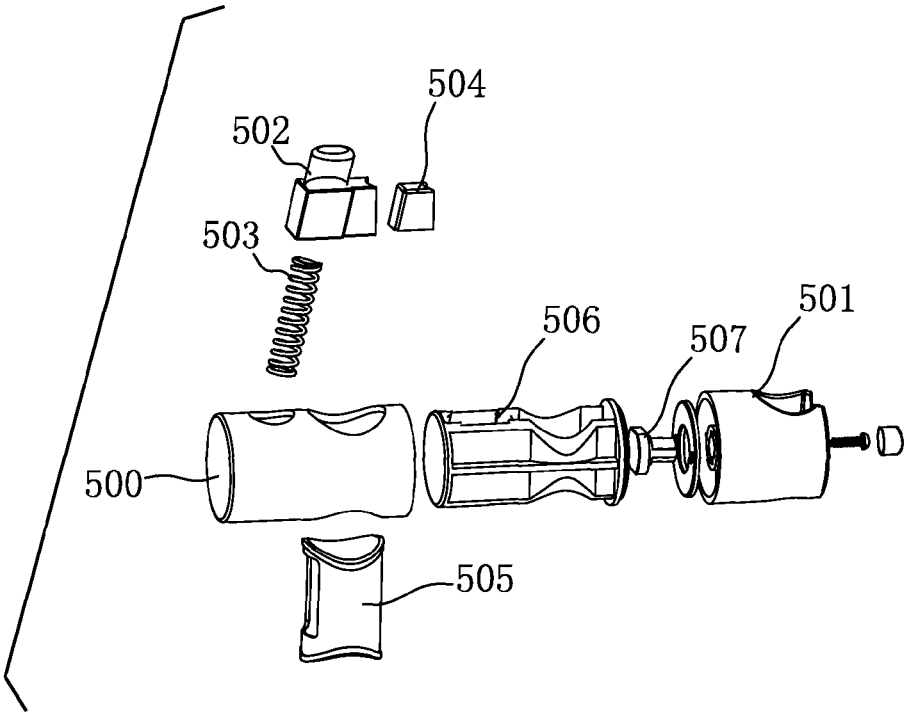
FIG. 8 shows the exploded view of the slide bushing in FIG. 7.

FIG. 7 shows the sectional view of the slide bushing 500; FIG. 8 shows the exploded view of the slide bushing according to the FIG. 7. These two views show the related details of the slide bushing 500. With the references of FIG. 5 and FIG. 6, it is known that the slide bushing has a elastic button 502, wherein the elastic button 502 can slide aslant up and down and has a compression spring 503 inside; a fastening end 504 interacts with the lateral face of the elastic button 502 by slide fit, wherein the elastic button 504 collides with the pipe 1 (not shown) inside through a jacket 505. Because of the inclined placement of the elastic button 502, the elastic button 502 slide up and down through the compression spring 503, and it squeezes the fastening end 504 to make the pipe in the jacket 505 fasten; the retaining to the pipe through the slide bushing 500 can be loosened by pressing the elastic button 502.

A shower seat 501 interacts with a lining frame 506 through a fasten revolving shaft 507 on the lateral face of the slide bushing 500 against the elastic button 502, wherein the lining frame 506 is inserted in and fixed with the slide bushing; the shower seat 501 can rotate integrally around the axle of the revolving shaft 507 against the slide bushing 500, so that the diversity of the shower seat's angles is achieved.

The invention has been described with reference to the preferred embodiments mentioned above; therefore it cannot limit the reference implementation of the invention. It is obvious to a person skilled in the art that structural modification and changes can be carried out without leaving the scope of the claims hereinbefore and the description above.

What is claimed is:

1. A shower assembly with supporting arm comprising:

a water inlet connected to the supporting arm and to a descending pipe;

a switching valve body fixed and connected to the end of said pipe through an outer water inlet and having an outer water outlet and a inner water outlet connected to a ascending inner tube in said pipe;

and an upper branch pipe fixed to the location of said water inlet and connected to said inner tube, of which the end has one or at least one upper water outlet;

wherein said switching valve body has a valve core inside, which makes said pipe connected to said outer water outlet and said inner water outlet respectively or simultaneously; from said water inlet, an intact current passage is formed through said pipe, outer water inlet, switching valve body, inner water outlet, inner tube and upper water outlet in turn.

2. A shower assembly with supporting arm according to claim 1, wherein the cross-sectional area of said inner tube is less than the result of the cross-sectional area of said pipe minus the cross-sectional area of said inner tube.

3. A shower assembly with supporting arm according to claim 2 wherein said water inlet has the universal ball structure.

4. A shower assembly with supporting arm according to claim 3, wherein said switching valve body has a fixed disk apparatus that can be fixed to the wall surface, and the connecting structure between the fixed disk and the wall surface could be adhesion, magnet, negative pressure or the combination of the three methods mentioned above.

5. A shower assembly with supporting arm according to claim 4, wherein said fixed disk apparatus includes a universal ball structure.

6. A shower assembly with supporting arm according to any one of claim 1, wherein the outer diameter of said upper branch pipe is identical to the outer diameter of said pipe at the position of said water inlet, and they all have smooth and continuous outside surface.

7. A shower assembly with supporting arm according to claim 6, wherein said upper branch pipe extends upwards from said water outlet to height and there is at least one downward elbow at the end of said upper branch pipe, wherein a head shower is fixed at the end of the elbow.

8. A shower assembly with supporting arm according to claim 7, wherein a tube is connected to the outer water outlet of said switching valve body, and a handheld shower is fixed and connected to another end of said tube.

9. A shower assembly with supporting arm according to claim 8, wherein a slide bushing is mounted on said pipe, which has a shower seat used to splice said handheld shower.

10. A shower assembly with supporting arm according to claim 9, wherein said valve core comprises:

a switching cavity connected to said outer water inlet, said inner water outlet and said outer water outlet;

a valve core axis reelingly interacted with the interior of said switching cavity, wherein a filler block reelingly blocking the current of said outer water inlet and/or said inner water outlet around said valve core axis is present;

a knob fixed to said valve core axis.

11. A shower assembly with supporting arm according to claim 10, wherein the outer diameter of said upper branch pipe is identical to the outer diameter of said pipe at the position of said water inlet, and they all have smooth and continuous outside surface.

12. A shower assembly with supporting arm according to claim 11, wherein said upper branch pipe extends upwards from said water outlet to height and there is at least one downward elbow at the end of said upper branch pipe, wherein a head shower is fixed at the end of the elbow.

13. A shower assembly with supporting arm according to claim 12, wherein a tube is connected to the outer water outlet of said switching valve body, and a handheld shower is fixed and connected to another end of said tube.

14. A shower assembly with supporting arm according to claim 13, wherein a slide bushing is mounted on said pipe, which has a shower seat used to splice said handheld shower.

15. A shower assembly with supporting arm according to claim 14, wherein said valve core comprises:

a switching cavity connected to said outer water inlet, said inner water outlet and said outer water outlet;

a valve core axis reelingly interacted with the interior of said switching cavity, wherein a filler block reelingly blocking the current of said outer water inlet and/or said inner water outlet around said valve core axis is present;

a knob fixed to said valve core axis.

* * * * *